US011267622B2

(12) United States Patent
Ferrari et al.

(10) Patent No.: US 11,267,622 B2
(45) Date of Patent: Mar. 8, 2022

(54) ASEPTIC CAP FOR CONTAINERS WITH EVIDENCE OF FIRST OPENING

(71) Applicant: AFFABA & FERRARI S.R.L., Borgo San Giovanni (IT)

(72) Inventors: Silvia Ferrari, Lodi (IT); Guglielmo Ferrari, Lodi (IT)

( * ) Notice: Subject to any disclaimer, the term of this patent is extended or adjusted under 35 U.S.C. 154(b) by 104 days.

(21) Appl. No.: 16/869,172

(22) Filed: May 7, 2020

(65) Prior Publication Data

US 2020/0354118 A1 Nov. 12, 2020

(30) Foreign Application Priority Data

May 10, 2019 (IT) ..... 102019000006724

(51) Int. Cl.
*B65D 47/08* (2006.01)
*B65D 41/34* (2006.01)

(52) U.S. Cl.
CPC ..... *B65D 47/0838* (2013.01); *B65D 41/3428* (2013.01); *B65D 47/0876* (2013.01); *B65D 2401/15* (2020.05)

(58) Field of Classification Search
CPC ..... B65D 47/0838; B65D 41/3428; B65D 47/0876; B65D 2401/15
See application file for complete search history.

(56) References Cited

U.S. PATENT DOCUMENTS 5,265,777 A 11/1993 Weinstein
6,039,218 A * 3/2000 Beck ..... B65D 41/3447 222/153.06
6,269,986 B1 * 8/2001 Gross ..... B65D 47/0804 222/541.5
2005/0269282 A1 * 12/2005 Luch ..... B65D 1/023 215/256
2020/0354118 A1 * 11/2020 Ferrari ..... B65D 41/3428

FOREIGN PATENT DOCUMENTS

EP 1582475 A1 10/2005
EP 2272771 A1 1/2011
FR 2842177 A1 1/2004
GB 2068913 A 8/1981

OTHER PUBLICATIONS

Italian Patent and Trademark Office, Search Report, dated Feb. 12, 2020 (Relevant portions are in English).

* cited by examiner

*Primary Examiner* — Vishal Pancholi
*Assistant Examiner* — Bob Zadeh
(74) *Attorney, Agent, or Firm* — Themis Law

(57) ABSTRACT

An aseptic cap for containers with evidence of first opening includes a protective cover positioned on a pouring element and produced as a single piece, which has an upper and a lower part connected by frangible bridges facing edges of the upper and the lower parts of the cover, and by a hinge arrangement. The pouring element includes a cylindrical element formed by two sections having different diameters separated by a step defined by a radial annular extension, which protrudes from the lower cylindrical part of the cover and is at least partially inserted in the upper part of the cover. The upper part of the cover has, in its interior, an appendix or flap which extends to rest above the annular extension, to become folded when the cap is mounted, and which is arranged straight downwardly to be abutted above the annular extension after the first opening.

8 Claims, 5 Drawing Sheets

ASEPTIC CAP FOR CONTAINERS WITH EVIDENCE OF FIRST OPENING

FIELD OF THE INVENTION

The present invention relates to an aseptic cap for containers with evidence of first opening.

BACKGROUND OF THE INVENTION

Closing caps that are relatively simplified may be positioned on containers or recipients for beverages and other liquid products, such as drinks with vitamin supplements, water with additives in general, juices, tea. These caps, called "flip top", generally essentially comprise a protective cover and an internal central pouring element.

The protective cover extends into a base collar which is positioned on the threaded part of the mouth of the container and is produced in a single piece, whereas the pouring element is arranged inside the cap, and kept blocked therein, ready to be also positioned with respect to the mouth of the container.

In general, these closure caps of a container must be constructed in such a way that, when placed on a container filled with their contents, they must not allow any opening or tampering of their contents.

They must, in fact, be such that, once opened for the first time, they can no longer be closed so as to appear to be untouched and never used before. All this is to ensure that the internal product is that inserted by the filling company and absolutely original. Furthermore, they must also be relatively simple to open, favoring the use of the beverage by the consumer.

Furthermore, as already mentioned, it must be possible to verify with extreme immediacy and simplicity, by observing the container provided with this kind of cap, that said container is intact, i.e. that a first opening has not already been effected, providing ample reassurance to the consumer of the product.

These problems and requests first of all create the necessity of providing a cap whose protective cover can be positioned very easily on the mouth of the container, once filled, and at the same time can also guarantee the prevention of opening and subsequent reclosing which does not show that the first opening has been effected. Once the cap has been positioned, it should not be possible to open it for any reason whatsoever without said opening being revealed and evident. In short, the cap must have an irreversible opening.

Secondly, this type of cap must be able to be positioned on the container with an optimal seal in its closed position when the container that receives it and on which it is positioned is ready for sale.

There are many examples of these caps to be positioned on a screw neck of a container, but most of them have great construction complexity and a certain number of constituent parts which make them complex. The presence of more than two parts consequently leads to assembly costs and the need for having more molds available with an increase in costs.

SUMMARY OF THE INVENTION

The objective of the present invention is therefore to find an adequate and different solution to the various problems revealed and indicated above.

A further objective of the invention is to provide a cap which is capable of guaranteeing evidence of any type of tampering with respect to its positioning in the filling phase with the original contents.

Yet another objective of the invention is to provide an aseptic cap for containers with evidence of first opening, which is simple and inexpensive and particularly simple to use and operate.

The above-mentioned objectives are achieved by an aseptic cap for containers with evidence of first opening produced as described hereinafter.

BRIEF DESCRIPTION OF THE DRAWINGS

The structural and functional characteristics of the present invention and its advantages with respect to the known art will become even more evident from the following description, referring to the attached schematic drawings, which show an embodiment example of the invention itself.

In the drawings.

DETAILED DESCRIPTION OF EMBODIMENTS OF THE INVENTION

Figure 1:
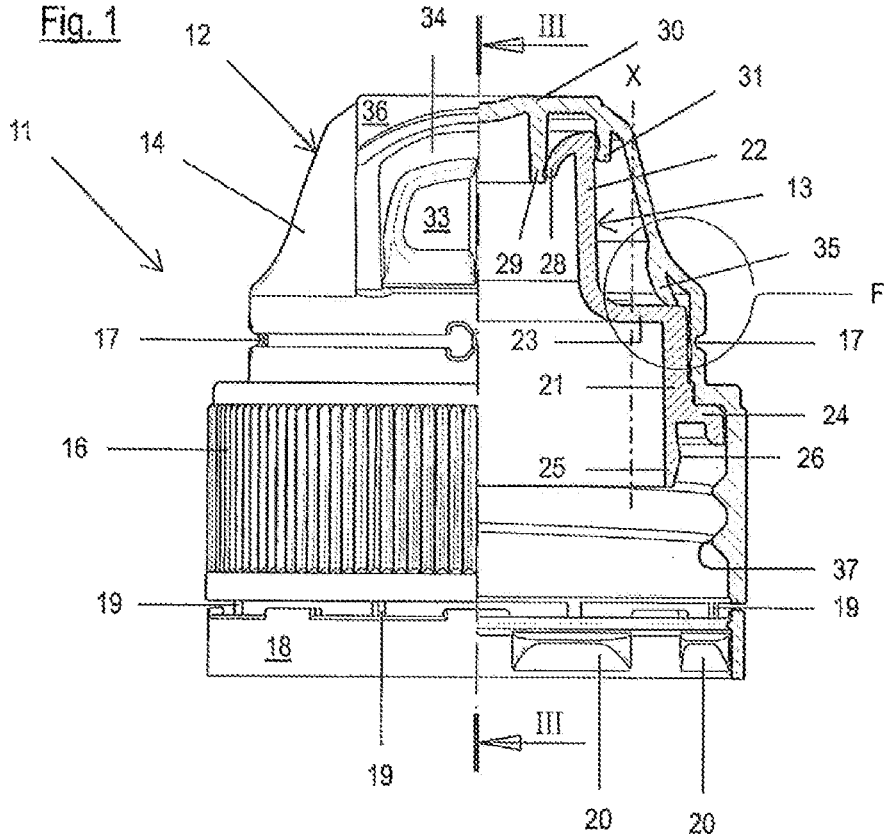
FIG. 1 shows a cap according to the present invention, half in a raised front view and half in a sectional view according to the line I-I of FIG. 2.
Figure 2:
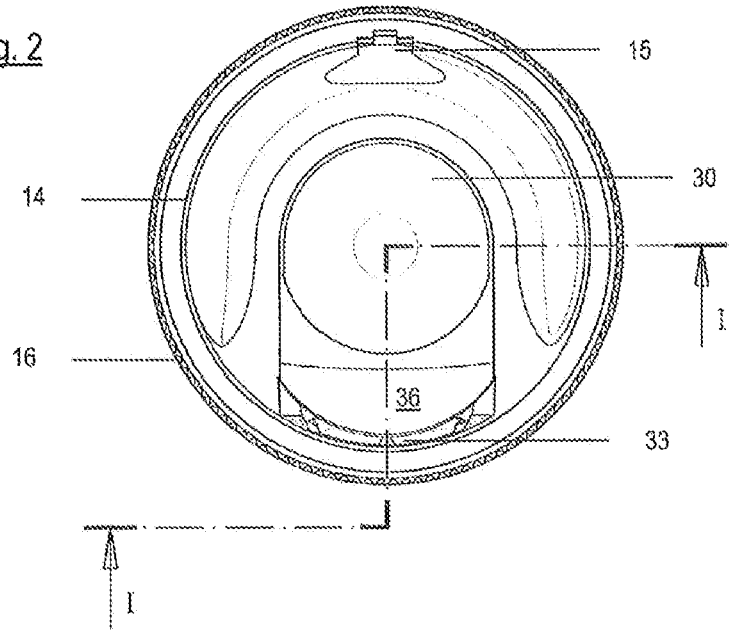
FIG. 2 is a plan view from above of the cap of FIG. 1.
Figure 3:
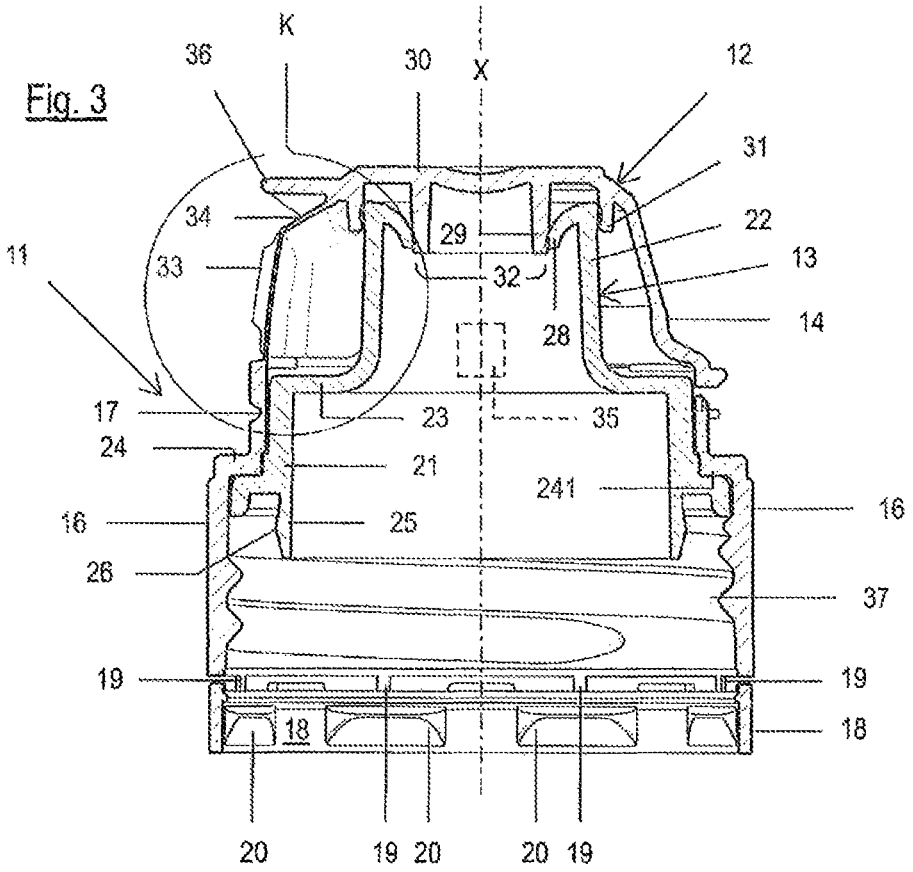
FIG. 3 is a section according to the line III-III of FIG. 1.

With general reference to the figures, these show by way of non-limiting example, an embodiment of an aseptic cap for containers with evidence of first opening, indicated as a whole with 11.

The aseptic cap 11 is arranged for closing a container, in particular on a screw neck (not shown), and comprises an external protective cover 12 and an internal pouring element 13. This type of cap, as already mentioned, is of the kind known as "flip top".

The protective cover 12 is produced in a single piece, for example by molding, and completely envelops the internal pouring element 13.

More specifically, the cover 12 is substantially in the form of an inverted cup and consists of an upper part 14 and a lower part 16 connected by means of a series of frangible bridges 17, produced in correspondence with facing edges of the upper part 14 and the lower part 16 of the cover 12.

The upper part 14 is also articulately connected to the lower part 16. In the example, the upper part 14 is shaped like an inverted bowl and is connected to the lower part 16 in a perimetric section facing the two parts 14, 16 through a hinge arrangement 15. The hinge arrangement 15 can consist, for example, of one or more adjacent bridges. The lower part 16 in the example is cylindrical in shape and is internally provided with a threading 37, at least in a section of the internal surface. Said threading 37 is provided for coupling with a complementary threading which is provided on the external part of the mouth of a container or recipient (not shown) on which the aseptic cap 11 is arranged.

The lower cylindrical part 16 of the cover 12, at its lower free end, provides a ring 18, connected to it by means of a series of frangible bridges 19. Said ring 18, along its internal diameter, provides a plurality of teeth 20 having a stable positioning on a perimetric cord protruding radially towards the outside of the mouth of the container or recipient (not shown) on which the aseptic cap 11, according to the present invention, is arranged.

The inner pouring element 13 is a cylindrical element composed of two sections having different diameters separated by a step: a lower section with a larger diameter 21 and an upper section with a smaller diameter 22. The two sections 21, 22 are connected by a central annular extension 23 arranged on a plane perpendicular to an axis X of the two sections 21, 22 of the cylindrical element in a radial direction in the cylindrical element to form said step.

The central annular extension 23 is arranged protruding from the lower cylindrical part 16 of the cover 12 and is at least partially inserted in the upper part 14 of the cover 12. In this way the series of frangible bridges 17, produced in correspondence with the two facing edges of the upper part 14 and lower part 16 of the cover 12, are arranged externally with respect to the lower section having a larger diameter 21 of the cylindrical element which forms the pouring element 13.

A lower end of the lower section 21 with a larger diameter has an annular flange 24 protruding radially outwardly with respect to said section 21. Said flange 24 is abutted inside the lower part 15 of the cover 12 before the internal threading 37 beneath an annular undercut 241 formed at the end of the threading 37. Furthermore, the pouring element 13 extends, almost adjacent and concentric inside the annular flange 24, into a smaller cylindrical terminal portion 25 suitable for being inserted inside the mouth of the container or recipient on which the aseptic cap 11 is arranged.

This cylindrical terminal portion 25 is externally provided with an annular molding 26, protruding radially outwardly, which causes the forced positioning of the cap 11 inside the mouth of the container. This positioning is assisted by an edge 27 produced in an intermediate portion of the cover 12. This edge 27 is annular and is perpendicular to the axis X and receives the annular flange 24 of the pouring element 13 in abutment. Said annular edge 27 forms a step in an intermediate area of the cover 12 where the pouring element 13 is permanently housed, as its annular flange 24 is positioned there in abutment. The positioning of the pouring element 13 is thus effected against the internal wall of the lower part 16 of the cover 12 where its internal threading 37 ends.

At the upper end of the pouring element 13 in correspondence with the end of the upper section 22 having a smaller diameter, an annular flap 28 is provided facing inwardly. A first tubular extension 29 is positioned inside and against said annular flap 28 which forms part of and extends downwardly from an upper wall 30 of the cover 12. A second tubular extension 31, having a larger diameter than the first extension 29, extends from the upper part 30 of the cover 12, coaxial with said first tubular extension 29 and also facing the same direction as the first tubular extension 29. The two tubular extensions 29 and 31 are positioned inside and astride of the upper end of the pouring element 13, even if it does not provide for said annular flap 28 facing inwardly, and they completely seal a passage 32 inside the pouring element 13 produced for discharging the contents of the container or recipient on which the aseptic cap 11 is arranged.

As previously described, the upper part 14 of the cover 12 provides the upper wall 30 and a shaped side jacket which comprises the above-mentioned hinge arrangement 15 for connection to the lower cylindrical part 16. A push-button 33 is positioned in an area opposite the hinge arrangement 15, which can be pressed towards the inside of the cap.

When pressed, the push-button 33 causes the deformation (or even breakage) of a film 34 of the cover arranged above the push-button 33 as far as the upper wall 30 of the cover. This film 34 insulates the pouring element 13 from the outside and is sealed against the outer part of the pouring element 13. The provision of the film 34 creates a complete seal with respect to the washing liquid and rinsing water, when the cap is produced and intact and as described in more detail hereunder.

Figure 4:
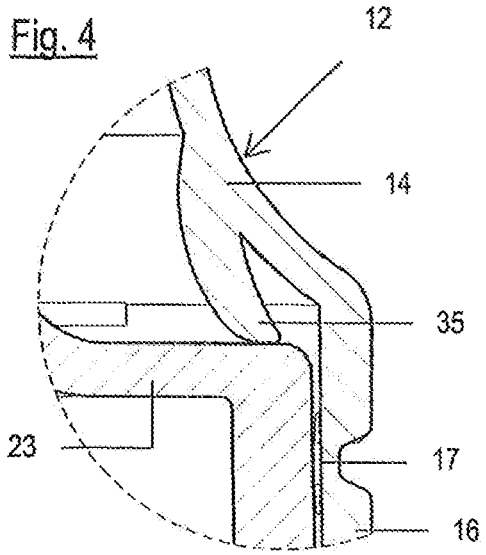
FIG. 4 shows an enlarged detail as indicated in the circle F shown in FIG. 1.
Figure 5:
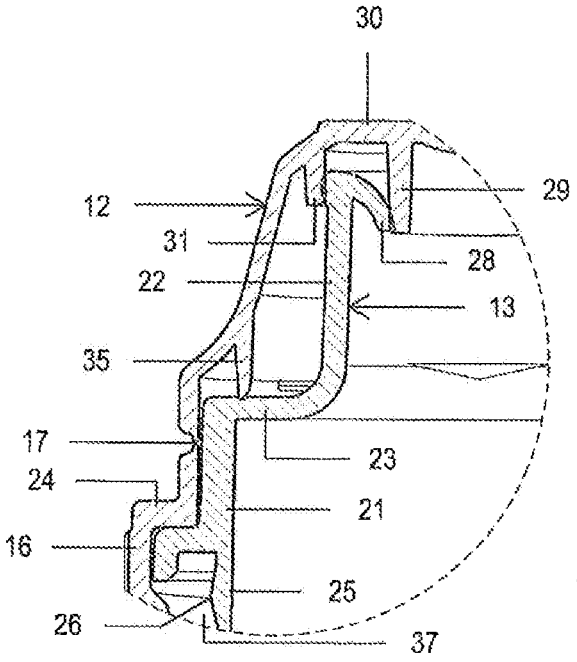
FIG. 5 shows a sectional detail of the sectional part of the cap shown in FIG. 1 when the first opening for the cap has been effected.
Figure 6:
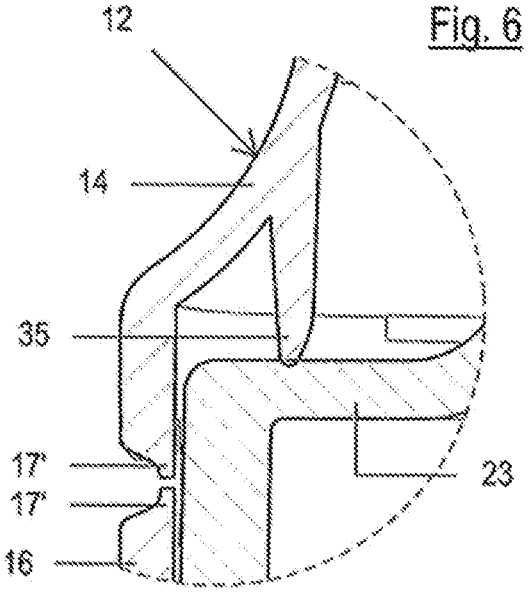
FIG. 6 shows an enlarged detail of what is shown in FIG. 5 above.
Figure 7:
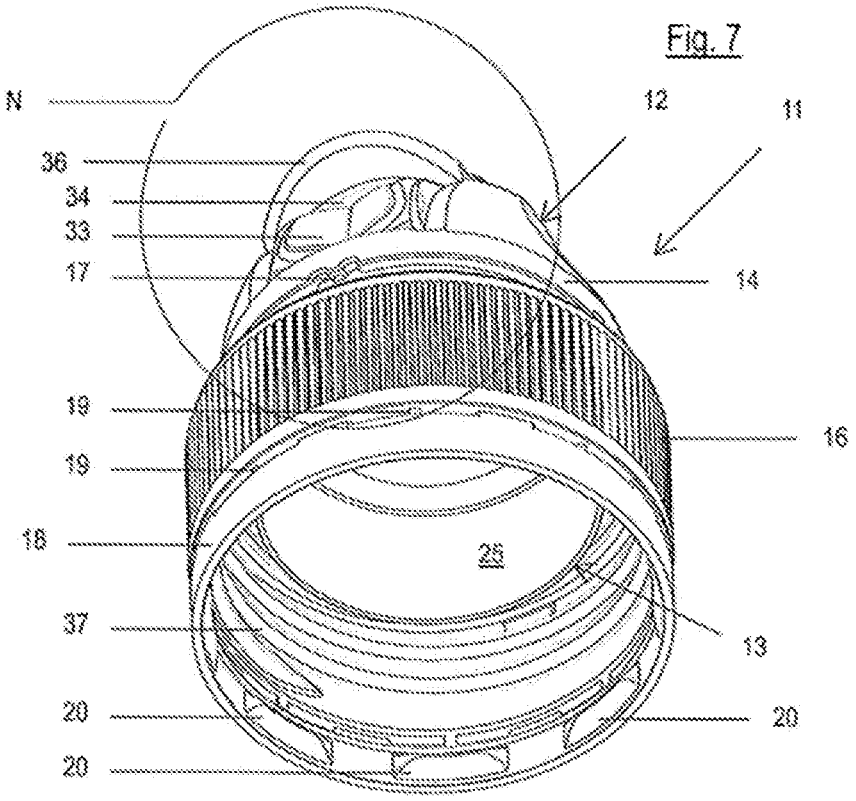
FIG. 7 shows a perspective view from below of the cap of FIG. 1 in an intact condition, without there having been any opening of the same.
Figure 8:
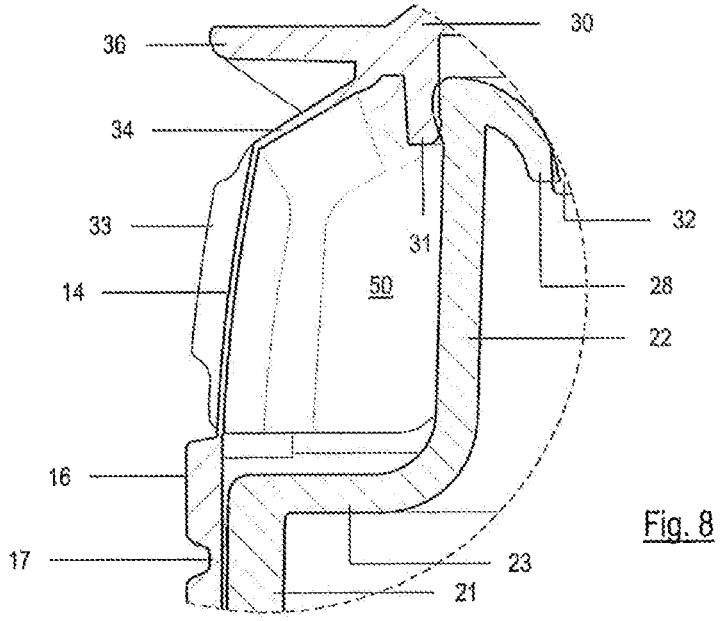
FIG. 8 shows an enlarged detail as indicated in the circle K shown in FIG. 3.
Figure 9:
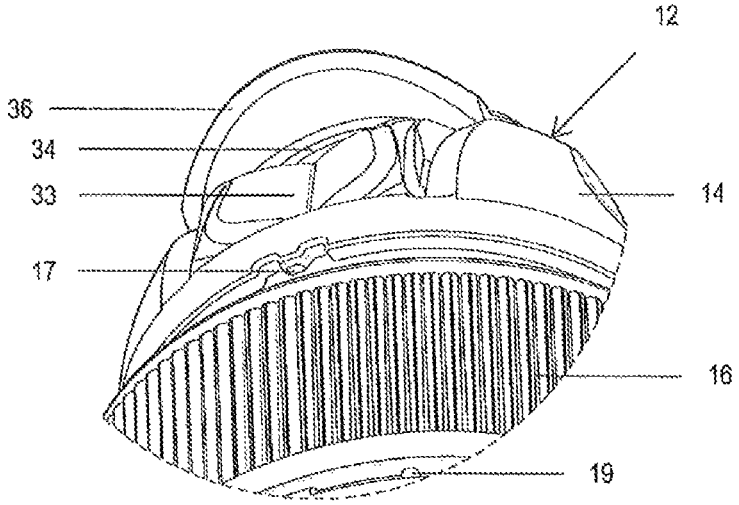
FIG. 9 shows an enlarged detail as indicated in the circle N shown in FIG. 7, when the first opening for the cap has been effected.
Figure 10:
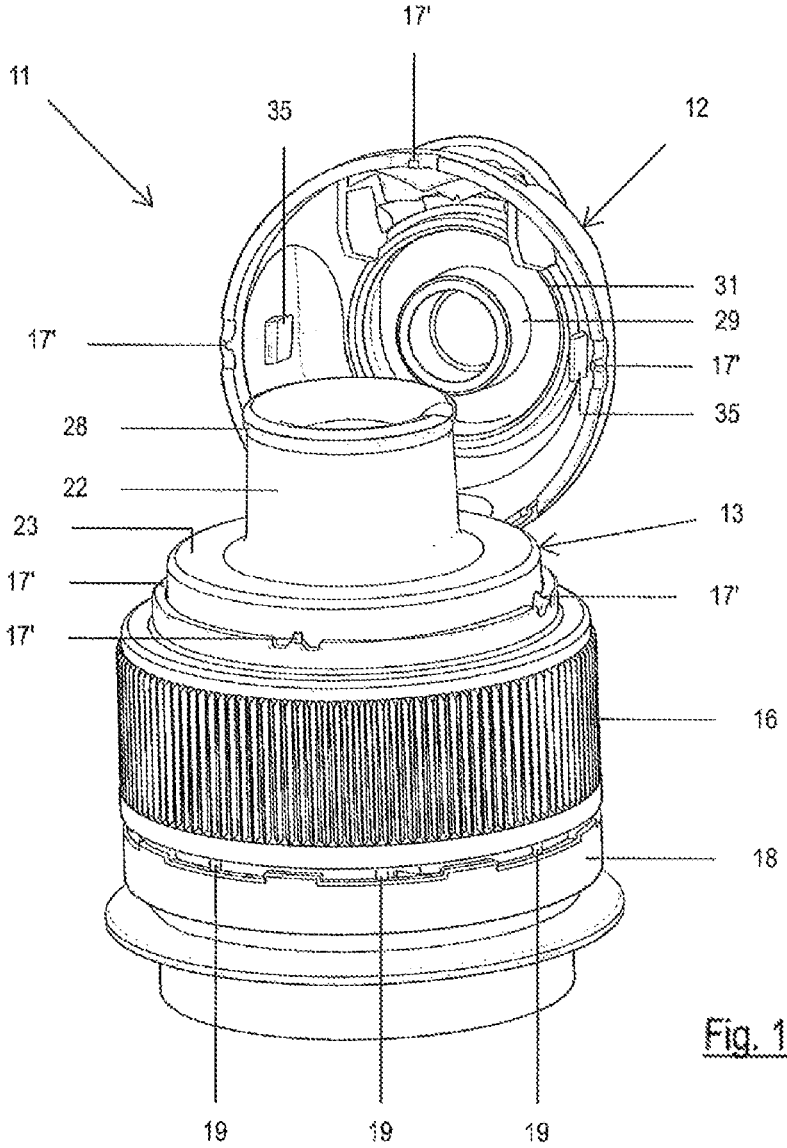
FIG. 10 is a perspective view illustrating the cap with the cover open clearly showing flaps or appendices in its interior, which prevent a complete reclosure of the cap, indicating that a first opening of the cap has been effected.

FIGS. 1 and 4 with the cap closed, as positioned on the container, show, in addition to what is indicated above, that the upper part 14 of the cover 12 provides in the example, in its interior, a pair of appendices or flaps 35 which extend towards the pouring element 13, symmetrically on opposite parts of the cap (only one is shown in the figures and only one can be provided in a simplified embodiment of the cap). More specifically, in this example illustrated, said pair of appendices or flaps 35 extends to rest above the central annular extension 23 provided between the two sections 21, 22 of the pouring element 13, bending in the production step of the cap when it is ready for use and for application on a container. These appendices or flaps 35, however, are arranged straight downwardly, abutting above the central annular extension 23 when the first opening of the upper part 14 of the cover 12 has been effected with respect to the lower cylindrical part 15 and the pouring element 13 and an attempt has been made to close the cover 12 on the pouring element 13. This arrangement, illustrated in FIGS. 5 and 6, shows how the presence of said appendices or flaps 35 directed downwardly, which are abutted above the underlying central annular extension 23, not only prevents a complete reclosure of the cover 12, but also reveals the first opening of the cover 12 with respect to the pouring element 13. In a closed position, in fact, and not opened for the first time, the upper part 14 of the cover 12 faces the lower part 16 and the two parts 14 and 16 are thus kept in contact with each other by the series of bridges 17. FIG. 10 shows the presence of the appendices 35 inside the cover 12, more clearly.

The arrangement of the two parts 14 and 16 is different when a first opening of the cap 11 has been effected with rotation of the upper part 14 with respect to the lower part 16 around the hinge arrangement 15, consisting of various bridges.

In order to do this, the user acts on an opening flap 36, protruding in an upper area of the upper part 14 of the cover, for example close to the push-button 33.

This thrust on the opening flap 36 causes the breakage of the series of bridges 17 provided between the upper part 14 and the lower part 16 of the cover 12, which keep them closed facing each other. In this way, the upper part 14 of the cover 12 is rotated around the hinge arrangement 15, consisting of various bridges, with respect to the lower part 16. There is therefore free access to the pouring element 13 with the possibility of pouring the beverage contained in the container.

The following FIGS. 5 and 6 show how the upper part 14 and the lower part 16 of the cover 12 remain apart, clearly showing that the cap 11 has been opened and therefore is no longer as it was produced and taken from the packaging with the original contents of the container.

FIG. 6, in fact, shows how one of the bridges 17 has been broken and its small facing portions 17' can be seen on the two facing edges of the upper part 14 and lower part 16 of the cover 12.

It can also be very clearly noted how the free end of the flap 35 is abutted on the annular flange 24 of the pouring element 13, as shown, preventing any possibility of closure between the two parts of the cover 12 of the cap 11.

This alerts and warns the user, as it can thus be seen that a first opening of the cap has already been made. And consequently, for example, the contents of the container may have been replaced or in any case the original contents may have tampered.

The cap can therefore no longer be reclosed even by forcing and is therefore always open.

As has been seen, the functioning of this type of cap according to the invention is extremely simple and immediate.

It should be pointed out that the cap of the present invention, when in a closed position, thanks to its characteristics, creates a perfect sealing assembly, guaranteeing the integrity of the products especially when the filling phase is made under aseptic conditions in specific plants. Its simple structure allows easy control of the correct implementation of the molding and assembly phases.

In particular, it has been said that the protective cover 12 of the present "flip top" cap is molded in a single piece and completely envelops the inner pouring element 13 on which it is sealed. It has also been said, in fact, that the construction of the single-piece cap 12 seal-envelops the underlying pouring element 13.

This arrangement can be very clearly seen on observing the figures.

It has been said, in fact, that the above-mentioned internal film 34 is provided above the push-button 33, which also forms part of the cover when produced in a single piece which also envelops the pouring element 13 in that point, causing inaccessibility to the same pouring element 13 on the part of washing and sterilization liquid with the cap as molded.

This inaccessibility to the pouring element 13 is also achieved by the presence of the first tubular extension 29 and the second tubular extension 31, having a larger diameter than the first extension 29, which are inserted in the passage 32 provided in the pouring element 13, closing it with a perfect seal with respect to the outside.

Furthermore, the two facing edges of the upper part 14 and lower part 16 of the cover 12 which are arranged outside the lower section having a larger diameter 21 of the pouring element 13 also prevent access to the washing liquid.

In this way, a chamber 50 inside the cover is created on the cap as produced and not opened, which makes the same pouring element 13 inaccessible on the part of washing and sterilizing liquid with the cap as molded.

Furthermore, the pouring element 13, when assembled inside the cover 12, creates a perfect seal with respect to the container on which the cap 11 is arranged. The provision of the annular flange 24, in fact, protruding radially outwardly with respect to the lower section 21 having a larger diameter of the pouring element 13 and also that of the annular undercut 241 formed inside the cover at the end of the threading 37 also creates an optimal seal.

All of this allows the cap to be washed when its two parts have been mounted with a suitable washing liquid, such as hydrogen peroxide vapor, making it sterile and above all preventing said washing liquid from being deposited in its interior.

Consequently, on the one hand the cap is sterile, and on the other, no residues of washing liquid are deposited in the cap which would then pollute the contents with which the container or recipient on which said cap must be positioned, is filled.

It has thus been seen that a cap according to the present invention achieves the objectives previously indicated.

The cap is particularly simple in structure and does not require complicated arrangements of parts, as it is composed of only two parts, i.e. cover and pouring element, which can be easily placed on the mouth of the container or recipient.

Thanks to the arrangement of the flaps or elements that prevent reclosure, said cap guarantees evidence of first opening.

The objective mentioned in the preamble of the description has thus been achieved.

The protection scope of the present invention is defined by the enclosed claims.

The invention claimed is:

1. An aseptic cap for containers with evidence of first opening, the aseptic cap comprising a protective cover positioned on a pouring element, wherein:

said protective cover is produced as a single piece and has an upper part and a lower part connected by frangible bridges, facing edges of the upper part and respectively the lower part of the protective cover, and by a hinge arrangement, said pouring element comprises a cylindrical element formed by two sections having different diameters separated by a step defined by an annular extension positioned on a plane perpendicular to a longitudinal axis of the two sections of the cylindrical element in a radial direction, said annular extension of said pouring element protrudes from the lower cylindrical part of the cover and is at least partially inserted in the upper part of the cover so that said frangible bridges are arranged externally with respect to one of said two sections of the cylindrical element of the pouring element having a larger diameter and inserted in said lower part of the protective cover, and the upper part of the protective cover has, in an interior of the upper part, at least one appendix or flap that extends to rest on said annular extension, in folded configuration, when the aseptic cap is mounted and ready for use on a container, and that is arranged straight downwardly to be abutted on said annular extension when the first opening of the upper part of the cover has been made with respect to the lower part of the protective cover and the pouring element, and when an attempt has been made to close the cover on the pouring element.

2. The aseptic cap according to claim 1, further comprising a pair of appendices or flaps arranged inside the upper part of the protective cover, said pair of appendices or flaps extending toward said annular extension of the pouring element and being positioned symmetrically at opposite sides of the aseptic cap.

3. The aseptic cap according to claim 1, wherein a first tubular extension and a second tubular extension, coaxial to one another, extend from an upper wall of the upper part of the protective cover inside the protective cover and toward the pouring element, the first tubular extension and the second tubular extension being positioned inside and astride a passage of the pouring element and closing said passage with a complete seal.

4. The aseptic cap according to claim 3, wherein said passage of said pouring element is coupled to an annular flap, which faces inwardly, and against and inside which said first tubular extension is positioned.

5. The aseptic cap according to claim 1, further comprising an annular flange extending from said one of said two sections of the cylindrical element of the pouring element having a larger diameter, said annular flange protruding radially and outwardly, and being is abutted inside the lower part of the protective cover beneath an annular undercut obtained therein.

6. The aseptic cap according to claim 1, wherein said lower part of the protective cover has an inner threading configured to receive a mouth of an externally threaded container.

7. The aseptic cap according to claim 1, wherein said upper part of said protective cover has a push-button adapted to be pressed toward an inside of the aseptic cap.

8. The aseptic cap according to claim 7, wherein said push-button causes a deformation or breakage of a film of the protective cover above said push-button, said film isolating the pouring element from an outside environment.

* * * * *